US007108779B1

(12) United States Patent
Thakkar

(10) Patent No.: US 7,108,779 B1
(45) Date of Patent: Sep. 19, 2006

(54) HYDROCARBON DESULFURIZATION PROCESS

(75) Inventor: Vasant P. Thakkar, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 529 days.

(21) Appl. No.: 10/670,869

(22) Filed: Sep. 25, 2003

(51) Int. Cl.
*C10G 69/02* (2006.01)

(52) U.S. Cl. ..... 208/89; 208/58; 208/78; 208/83; 208/108; 208/210

(58) Field of Classification Search ..... 208/58, 208/89, 78, 108, 210, 83
See application file for complete search history.

(56) References Cited

U.S. PATENT DOCUMENTS

| | | | | |
|---|---|---|---|---|
| 5,114,562 | A | 5/1992 | Haun et al. | 208/89 |
| 6,296,758 | B1 * | 10/2001 | Kalnes et al. | 208/89 |
| 6,379,533 | B1 * | 4/2002 | Thakkar et al. | 208/59 |
| 6,596,155 | B1 * | 7/2003 | Gates et al. | 208/89 |
| 6,676,828 | B1 * | 1/2004 | Galiasso et al. | 208/58 |

* cited by examiner

*Primary Examiner*—Tam M. Nguyen
(74) *Attorney, Agent, or Firm*—John G. Tolomei; James C. Paschall; John G. Cutts, Jr.

(57) ABSTRACT

A process for the production of low sulfur hydrocarbonaceous products. The hydrocarbon feedstocks are processed in integrated desulfurization zone, hydrocracking and hydrogenation zones to produce ultra low sulfur diesel, low sulfur naphtha products and low sulfur heavy distillate.

8 Claims, 1 Drawing Sheet

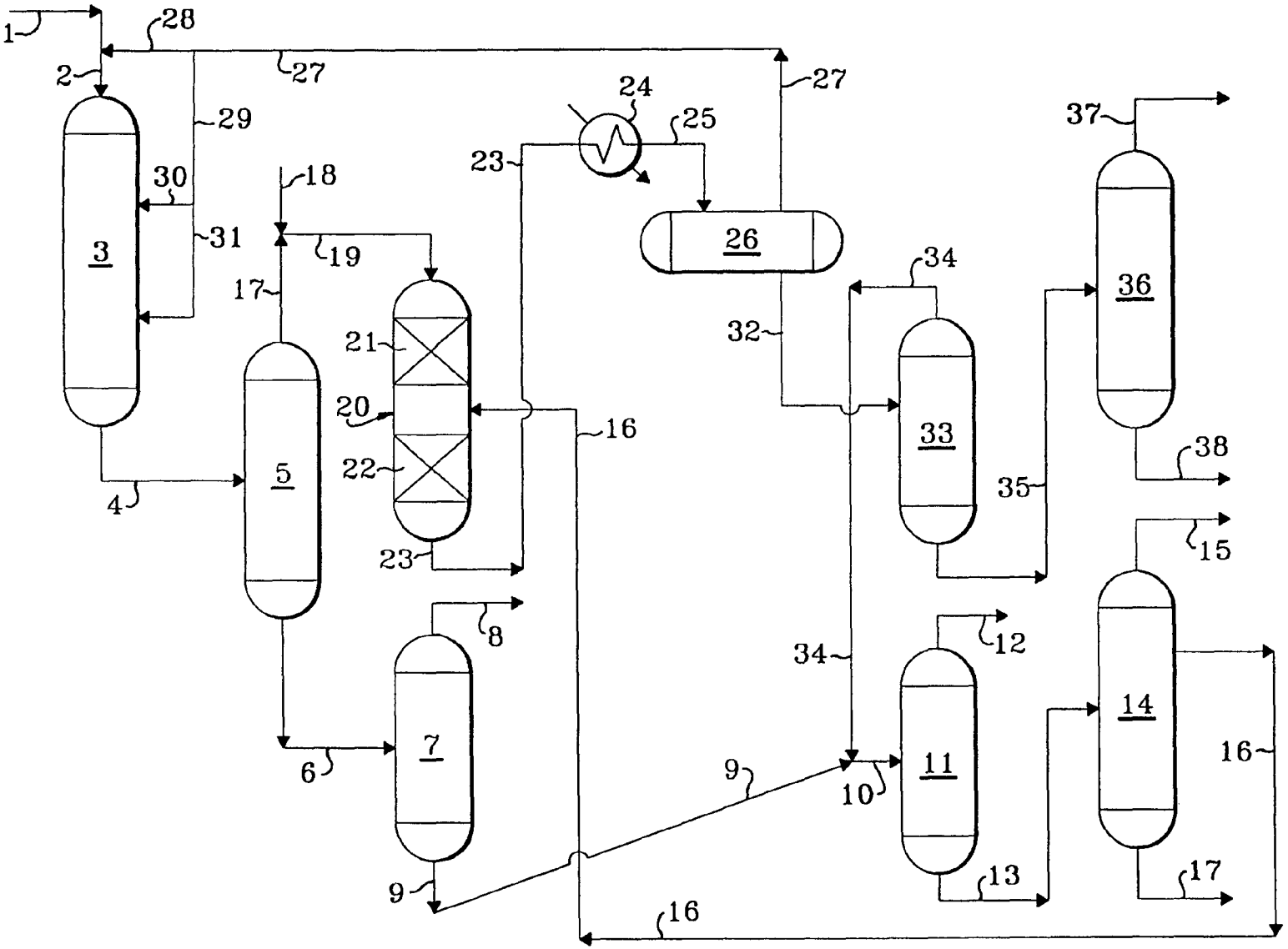
1
2
3
4
5
6
7
8
9
10
11
12
13
14
15
16
17
18
19
20
21
22
23
24
25
26
27
28
29
30
31
32
33
34
35
36
37
38

HYDROCARBON DESULFURIZATION PROCESS

BACKGROUND OF THE INVENTION

The field of art to which this invention pertains is desulfurization of hydrocarbon feedstocks to low levels of sulfur. Hydrodesulfurization processes have been used by petroleum refiners to produce more valuable hydrocarbonaceous streams such as naphtha, gasoline, kerosene and diesel, for example, having lower concentrations of sulfur and nitrogen. Feedstocks most often subjected to hydrotreating or desulfurization are normally liquid hydrocarbonaceous streams such as naphtha, kerosene, diesel, gas oil, vacuum gas oil (VGO) and reduced crude, for example. Traditionally, hydrodesulfurization severity is selected to produce an improvement sufficient to produce a marketable product or a suitable feedstock for downstream processing. Over the years, it has been recognized that due to environmental concerns and newly enacted rules and regulations, saleable products must meet lower and lower limits on contaminants such as sulfur and nitrogen. Recently new regulations were proposed in the United States and Europe which basically require the complete removal of sulfur from liquid hydrocarbons which are used as transportation fuels such as gasoline and diesel.

Desulfurization is generally accomplished by contacting the hydrocarbonaceous feedstock in a desulfurization reaction vessel or zone with a suitable desulfurization catalyst under conditions of elevated temperature and pressure in the presence of hydrogen to yield a product containing the desired maximum limits of sulfur. The operating conditions and the desulfurization catalysts within the desulfurization reactor influence the quality of the desulfurized products.

Although a wide variety of process flow schemes, operating conditions and catalysts have been used in commercial desulfurization activities, there is always a demand for new desulfurization methods which provide lower costs and the required product quality. With the mandated low sulfur transportation fuels, the process of the present invention greatly improves the economic benefits of producing low sulfur fuels.

INFORMATION DISCLOSURE

U.S. Pat. No. 5,114,562 B1 (Haun et al) discloses a process wherein middle distillate petroleum streams are hydrotreated to produce a low sulfur and low aromatic product in two reaction zones in series. The effluent of the first reaction zone is purged of hydrogen sulfide by hydrogen stripping and then reheated by indirect heat exchange. The second reaction zone employs a sulfur-sensitive noble metal hydrogenation catalyst.

BRIEF SUMMARY OF THE INVENTION

The present invention is an improved process for the production of low sulfur hydrocarbonaceous products. A first hydrocarbonaceous feedstock comprising hydrocarbon components boiling above about 343° C. (650° F.) and hydrogen is reacted in a first desulfurization zone to produce a first desulfurization zone effluent which is introduced into a vapor-liquid separator operated at an elevated temperature to provide a vaporous stream comprising lower boiling hydrocarbonaceous compounds and hydrogen and a liquid hydrocarbonaceous stream comprising hydrocarbon components having a reduced concentration of sulfur. The vaporous stream comprising lower boiling hydrocarbonaceous compounds, hydrogen, a second hydrocarbonaceous feedstock comprising hydrocarbon components boiling below about 371° C. (700° F.) are reacted in a hydrocracking zone to produce a hydrocracking zone effluent which is introduced together with a hydrocarbonaceous recycle stream preferably boiling in the range from about 149° C. (300° F.) to about 371° C. (700° F.) to a hydrogenation zone to produce a hydrogenation zone effluent which is fractionated to produce an ultra low sulfur hydrocarbonaceous stream preferably boiling in the range from about 149° C. (300° F.) to about 371° C. (700° F.). The liquid hydrocarbonaceous stream provided by the vapor-liquid separator is fractionated to produce a hydrocarbonaceous recycle stream preferably boiling in the range from about 149° C. (300° F.) to about 371° C. (700° F.) and a liquid hydrocarbonaceous stream comprising hydrocarbon components boiling above about 371° C. (700° F.) and having a reduced concentration of sulfur.

Other embodiments of the present invention encompass further details such as types and descriptions of feedstocks, desulfurization catalysts, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a more efficient and economical production of ultra low sulfur hydrocarbon products including ultra low sulfur diesel stock can be achieved and enjoyed in the above-described integrated hydrodesulfurization and hydrocracking process.

In accordance with the present invention, the first feedstock which is introduced into the first desulfurization zone preferably contains components boiling above about 343° C. (650° F.) and more preferably boiling above about 371° C. (700° F.) and includes, for example, atmospheric gas oils, vacuum gas oils, cracked gas oils, coker distillates, straight run distillates, solvent deasphalted oils, pyrolysis-derived oils, high boiling synthetic oils and cat cracker distillates. A preferred feedstock is a gas oil or other fraction having at least about 50% by weight and most usually at least about 75% by weight of its components boiling at a temperature between about 315° C. (600° F.) and 538° C. (1000° F.).

The first feedstock is reacted with hydrogen in a first desulfurization zone containing desulfurization catalyst operated at desulfurization conditions. Preferred desulfurization conditions include a temperature from about 204° C. (400° F.) to about 482° C. (900° F.) and a liquid hourly space velocity of the hydrocarbonaceous feed from about 0.1 $hr^{-1}$ to about 10 $hr^{-1}$.

Suitable desulfurization catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalysts include zeolitic catalysts, as well as noble metal catalysts where the noble metal is selected from palladium and platinum. It is within the scope of the present invention that more than one type of desulfurization catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical desulfurization temperatures range from about 204° C. (400° F.) to about 482° C. (900° F.) with pressures from about 2.1 MPa (300 psig) to about 17.3 MPa (2500 psig), preferably from about 2.1 MPa (300 psig) to about 13.9 MPa (2000 psig).

The resulting effluent from the first desulfurization zone is introduced into a vapor-liquid separator preferably operated at a temperature greater than about 288° C. (550° F.) to provide a vaporous stream comprising hydrogen, hydrogen sulfide and lower boiling hydrocarbonaceous compounds boiling up to about 371° C. (700° F.) and a first liquid hydrocarbonaceous stream comprising hydrocarbon components boiling above about 371° C. (700° F.) and having a reduced concentration of sulfur. This first liquid hydrocarbonaceous stream also contains a portion of hydrocarbons boiling in the range from about 149° C. (300° F.) to about 371° C. (700° F.) is preferably introduced into a hot flash zone, then a cold flash zone and subsequently fractionated to provide a hydrocarbonaceous recycle stream containing hydrocarbons boiling in the range from about 149° C. (300° F.) to about 371° C. (700° F.) and a second liquid hydrocarbonaceous stream comprising hydrocarbon components boiling above about 371° C. (700° F.) and having a reduced concentration of sulfur. This second liquid hydrocarbonaceous stream is preferably utilized as a suitable feedstock for a fluid catalytic cracking process. The vaporous stream comprising hydrogen, hydrogen sulfide and lower boiling hydrocarbonaceous compounds boiling up to about 371° C. (700° F.) and a second hydrocarbonaceous feedstock comprising hydrocarbon components boiling below about 371° C. (700° F.) is passed to a hydrocracking zone containing hydrocracking catalyst to produce a hydrocracking zone effluent. The second hydrocarbonaceous feedstock may be any suitable feedstock boiling below about 371° C. (700° F.) and preferably boils in the range from about 177° C. (350° F.) to about 371° C. (700° F.). Such suitable feedstocks, for example, include straight run middle distillate, kerosene and diesel boiling range hydrocarbons, coker distillate and light cycle oil.

The hydrocracking zone may contain one or more beds of the same or different catalyst. In one embodiment, when the preferred products are middle distillates the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°–648° C. (700°–1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking is conducted in the presence of hydrogen and preferably at hydrocracking conditions which include a temperature from about (232° C.) (450° F.) to about 468° C. (875° F.), a pressure from about 3548 kPa (500 psig) to about 20785 kPa (3000 psig), a liquid hourly space velocity (LHSV) from about 0.1 to about 30 $hr^{-1}$, and a hydrogen circulation rate from about 337 normal $m^3/m^3$ (2000 standard cubic feet per barrel) to about 4200 normal $m^3/m^3$ (25,000 standard cubic feet per barrel).

The hydrocracking zone effluent and a hydrocarbonaceous recycle stream preferably boiling in the range from about 232° C. (450° F.) to about 371° C. (700° F.) is preferably passed directly into a hydrogenation zone containing hydrogenation catalyst to produce a hydrogenation zone effluent. The hydrogenation catalyst may be selected from any known hydrogenation or desulfurization catalyst. This catalyst may be the same or different from the desulfurization catalyst used in the desulfurization zone and may be selected from known desulfurization catalysts such as those described hereinabove for example. Preferred hydrogenation conditions may be selected from those ranges taught for the desulfurization zone and may be more, less or equal to the severity of reaction conditions selected for the desulfurization zone.

The resulting hydrogenation zone effluent is partially condensed and introduced into a cold vapor-liquid separator operated at a temperature from about 21° C. (70° F.) to about 60° C.(140° F.) to produce a hydrogen-rich gaseous stream containing hydrogen sulfide and a liquid hydrocarbonaceous stream. The resulting hydrogen-rich gaseous stream is preferably passed through an acid gas scrubbing zone to reduce the concentration of hydrogen sulfide to produce a purified hydrogen-rich gaseous steam, a portion of which may then be recycled as desired or required. The liquid hydrocarbonaceous steam from the cold vapor-liquid separator is preferably introduced into a cold flash drum to remove dissolved hydrogen and normally gaseous hydrocarbons and subsequently sent to a fractionation zone to produce a low sulfur diesel product stream. It is preferred that the diesel product stream contains less than about 50 wppm sulfur, more preferably 10 wppm sulfur. The make-up hydrogen may be introduced into the process at any convenient location.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising a heavy vacuum gas oil enters the process through line 1 and is admixed with a hydrogen-rich gaseous stream provided via line 28 and the resulting admixture is introduced via line 2 into desulfurization zone 3. Hydrogen quench is provided to desulfurization zone 3 via lines 30 and 31. A resulting effluent from desulfurization zone 3 is transported via line 4 and introduced into hot vapor-liquid separator 5. A gaseous stream comprising hydrogen, hydrogen sulfide and lower boiling range hydrocarbons is removed from hot vapor-liquid separator 5 via line 17 and is admixed with a light cycle oil carried via line 18 and boiling in the middle distillate range, and the resulting admixture is transported via line 19 and introduced into reactor 20 wherein the stream contacts hydrocracking zone 21. The resulting effluent from hydrocracking zone 21 is passed directly to hydrogenation zone 22 which is contained in reaction zone 20. A resulting effluent from hydrogenation zone 22 is carried via line 23 and introduced into heat-exchanger 24. A resulting cooled and partially condensed stream is removed from heat-exchanger 24 via line 25 and introduced into cold vapor-liquid separator 26. A hydrogen-rich gaseous stream is removed from cold vapor-liquid separator 26 via line 27 and is introduced into desulfurization zone 3 via lines 28, 29, 30 and 31 as hereinabove described. A liquid hydrocarbonaceous stream is removed from cold vapor-liquid separator 26 via line 32 and introduced into cold flash drum 33. A gaseous stream comprising hydrogen and normally gaseous hydrocarbons is removed from cold flash drum 33 via line 34. A liquid stream comprising diesel boiling range hydrocarbons is removed from cold flash drum 33 via line 35 and introduced into fractionation zone 36. An ultra low sulfur diesel stream is recovered from fractionation zone 36 and is removed therefrom via line 38. A hydrocarbonaceous stream comprising compounds boiling below the diesel range is removed from fractionation zone 36 via line 37 and recovered. A liquid stream is removed from hot vapor-liquid separator via line 6 and introduced into hot flash drum 7. A vapor stream comprising hydrogen and lower boiling hydrocarbons is removed from hot flash drum 7 via line 8 and recovered. A liquid hydrocarbonaceous stream containing hydrocarbons boiling at a temperature greater than 371° C. (700° F.) and diesel boiling range hydrocarbons is removed from hot flash drum 7 via line 9 and is introduced along with a hereinabove described vapor stream provided via line 34 and the resulting admixture is introduced via line 10 into stripping zone 11. A stream comprising hydrogen, normally gaseous hydrocarbons and gasoline boiling range hydrocarbons is removed from stripping zone 11 via line 12 and recovered. A liquid hydrocarbonaceous stream comprising hydrocarbons boiling at a temperature greater than 371° C. (700° F.) and diesel boiling range hydrocarbons is removed from stripping zone 11 via line 13 and introduced into fractionation zone 14. A stream comprising lower boiling hydrocarbons is removed from fractionation zone 14 via line 15 and recovered. A liquid hydrocarbonaceous stream comprising hydrocarbons boiling at a temperature greater than 371° C. (700° F.) is removed from fractionation zone 14 via line 17 and recovered. A liquid stream comprising diesel boiling range hydrocarbons is removed from fractionation zone 14 via line 16 and is introduced into reaction zone 20 as hereinabove described.

The foregoing description and drawing clearly illustrate the advantages encompassed by the process of the present invention and the benefits to be afforded with the use thereof.

What is claimed is:

1. A process for desulfurizing two hydrocarbonaceous feedstocks which process comprises the following steps:

(a) reacting a first hydrocarbonaceous feedstock comprising hydrocarbon components boiling above about 343° F. (650° F.) and hydrogen with a desulfurization catalyst in a desulfurization zone operated at desulfurization conditions to produce a desulfurization zone effluent;

(b) introducing the desulfurization zone effluent into a vapor-liquid separator operated at a temperature greater than about 288° C. (550° F.) to provide a vaporous stream comprising hydrogen, hydrogen sulfide and lower boiling hydrocarbonaceous compounds boiling up to about 371° C. (700° F.) and a first liquid hydrocarbonaceous stream comprising hydrocarbon components boiling above about 371° C. (700° F.) and having a reduced concentration of sulfur;

(c) passing the vaporous stream comprising hydrogen, hydrogen sulfide and lower boiling hydrocarbonaceous compounds boiling up to about 371° C. (700° F.) and a second hydrocarbonaceous feedstock comprising hydrocarbon components boiling below about 371° C. (700° F.) to a hydrocracking zone to produce a hydrocracking zone effluent;

(d) passing the hydrocracking zone effluent and a hydrocarbonaceous recycle stream boiling in the range from about 149° C. (300° F.) to about 371° C. (700° F.) to a hydrogenation zone to produce a hydrogenation zone effluent;

(e) fractionating the hydrogenation zone effluent to produce an ultra low sulfur hydrocarbonaceous steam boiling in the range from about 149° C. (300° F.) to about 371° C. (700° F.); and (f) fractionating the liquid hydrocarbonaceous steam recovered in step (b) to produce a hydrocarbonaceous recycle stream boiling in the range from about 149° C. (300° F.) to about 371° C. (700° F.) and a second liquid hydrocarbonaceous stream comprising hydrocarbon components boiling above about 371° C. (700° F.) and having a reduced concentration of sulfur.

2. The process of claim 1 wherein the first feedstock is selected from the group consisting essentially of atmospheric gas oil, vacuum gas oil, coker distillates, cracked gas oils and admixtures thereof.

3. The process of claim 1 wherein the operating conditions for the desulfurization zone include a temperature from about 204° C. (400° F.) to about 482° C. (900° F.), a pressure from about 2.1 MPa (300 psig) to about 17.3 MPa (2500 psig) and a liquid hourly space velocity from about 0.1 $hr^{-1}$ to about 10 $hr^{-1}$.

4. The process of claim 1 wherein the operating conditions for the hydrogenation zone include a temperature from about 204° C. (400° F.) to about 482° C. (900° F.), a pressure from a bout 2.1 MPa (300 psig) to about 17.3 MPa (2500 psig) and a liquid hourly space velocity from about 0.1 $hr^{-1}$ to about 10 $hr^{-1}$.

5. The process of claim 1 wherein the ultra low sulfur hydrocarbonaceous stream produced in step (e) contains less than about 50 wppm sulfur.

6. The process of claim 1 wherein the ultra low sulfur hydrocarbonaceous stream produced in step (e) contains less than about 10 wppm sulfur.

7. The process of claim 1 wherein the second feedstock is selected from the group consisting of light cycle oil, straight run middle distillate, kerosene and diesel boiling range hydrocarbons and coker distillate.

8. A process for desulfurizing two hydrocarbonaceous feedstocks which process comprises the following steps:

(a) reacting a first hydrocarbonaceous feedstock selected from the group consisting essentially of atmospheric gas oil, vacuum gas oil, coker distillates, cracked gas oils and admixtures thereof, and hydrogen with a desulfurization catalyst in a desulfurization zone operated at desulfurization conditions to produce a desulfurization zone effluent;

(b) introducing the desulfurization zone effluent into a vapor-liquid separator operated at a temperature greater than about 288° C. (550° F.) to provide a vaporous stream comprising hydrogen, hydrogen sulfide and lower boiling hydrocarbonaceous compound boiling up to about 371° C. (700° F.) and a first liquid hydrocarbonaceous stream comprising hydrocarbon components boiling above about 371° C. (700° F.) and having a reduced concentration of sulfur;

(c) passing the vaporous stream comprising hydrogen, hydrogen sulfide and lower boiling hydrocarbonaceous compounds boiling up to about 371° C. (700° F.) and a second hydrocarbonaceous feedstock selected from the group consisting of light cycle oil, straight run middle distillate, kerosene and diesel boiling range hydrocarbons and coker distillate to a hydrocracking zone to produce a hydrocracking zone effluent;

(d) passing the hydrocracking zone effluent and a hydrocarbonaceous recycle stream boiling in the range from about 149° C. (300° F.) to about 371° C. (700° F.) to a hydrogenation zone to produce a hydrogenation zone effluent;

(e) fractionating the hydrogenation zone effluent to produce an ultra low sulfur hydrocarbonaceous stream boiling in the range from about 149° C. (300° F.) to about 371° C. (700° F.); and (f) fractionating the liquid hydrocarbonaceous stream recovered in step (b) to produce a hydrocarbonaceous recycle steam boiling in the range from about 149° C. (300° F.) to about 371° C. (700° F.) and a second liquid hydrocarbonaceous stream comprising hydrocarbon components boiling above about 371° C. (700° F.) and having a reduced concentration of sulfur.

* * * * *